US008117684B1

(12) United States Patent
Strapp

(10) Patent No.: US 8,117,684 B1
(45) Date of Patent: Feb. 21, 2012

(54) COMBINED TOILET AND AUTOMATED TOILET SEAT LIFTING DEVICE AND ASSOCIATED METHOD

(76) Inventor: Norma R. Strapp, Odessa, FL (US)

( * ) Notice: Subject to any disclaimer, the term of this patent is extended or adjusted under 35 U.S.C. 154(b) by 779 days.

(21) Appl. No.: 12/214,694

(22) Filed: Jun. 20, 2008

Related U.S. Application Data

(60) Provisional application No. 60/936,693, filed on Jun. 22, 2007.

(51) Int. Cl.
*A47K 13/10* (2006.01)

(52) U.S. Cl. ..... 4/246.1

(58) Field of Classification Search ..... 4/246.1–246.5; 220/211; 74/415; 310/75 R
See application file for complete search history.

(56) References Cited

U.S. PATENT DOCUMENTS

| | | | | |
|---|---|---|---|---|
| 3,118,571 | A * | 1/1964 | Reynolds | 222/616 |
| 5,307,524 | A | 5/1994 | Veal | |
| 6,510,562 | B1 * | 1/2003 | Bae et al. | 4/246.1 |
| 6,539,557 | B1 * | 4/2003 | Avila | 4/240 |
| 2005/0217010 | A1 | 10/2005 | Hayashi | |
| 2006/0005309 | A1 | 1/2006 | Aurora | |
| 2008/0116754 | A1 * | 5/2008 | Pellegrino et al. | 310/58 |
| 2009/0025134 | A1 * | 1/2009 | Stephens | 4/498 |

* cited by examiner

*Primary Examiner* — Gregory L. Huson
*Assistant Examiner* — Janie Christiansen

(57) ABSTRACT

A combined toilet and automated toilet seat lifting device may include a toilet that has a toilet seat pivotally attached thereto, and a mechanism for automatically articulating the toilet seat from a remote distance such that a user maintains their hands spaced from the toilet seat while the toilet seat travels along an arcuate path defined between fully raised and lowered positions respectively. Such an automatic articulating mechanism is preferably and selectively adapted between alternate operating modes, and each of the operating modes may cause the toilet seat to articulate at a unique and constant velocity along the arcuate path respectively.

6 Claims, 4 Drawing Sheets

COMBINED TOILET AND AUTOMATED TOILET SEAT LIFTING DEVICE AND ASSOCIATED METHOD

CROSS REFERENCE TO RELATED APPLICATIONS

This application claims the benefit of U.S. Provisional Application No. 60/936,693, filed Jun. 22, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION TECHNICAL FIELD

This invention relates to toilet seat lifting devices and, more particularly, to a combined toilet and automated toilet seat lifting device.

PRIOR ART

Without need for excessive elaboration, it is generally understood that in at least one respect, whether a person is male or female usually determines in what position, either up or down, that person would prefer a toilet seat to be in for use of the toilet. Generally, a male prefers the toilet seat to be in a raised position, while the female prefers the toilet seat to be in a lowered position for conformity with their respective anatomies. Typically, due to a male's behavioral patterns, however, it is widely accepted that in at least a substantial number of cases the male will not return the toilet seat to its lowered position after his use, thus rendering the toilet unsuitable for use by a subsequent female user.

A toilet seat remaining in an upright position could lead to a number of problems. In many occasions a certain amount of animosity between the females and males in a dual gender household may arise if the females have to continually return the toilet seat to its lowered position for their use. Further complications could arise if a female, in a partially somnolent state, attempted to use the toilet in the dark when the seat was in a raised position. Moreover, a raised toilet seat leads to a certain level of unsightliness, thus, possibly causing further tension if certain members of the household attempt to maintain the bathroom area in an orderly manner. Other problems could arise for a toilet user if the toilet seat was not in the most desirable configuration for a specific user. Some of these problems include difficulty in the manual operation of lowering or raising the toilet seat by persons suffering a variety of illnesses or handicaps, or by small children:

In addition to a toilet seat remaining in a prolonged raised position, there is also a certain loss of hygiene which occurs when a user is required to physically make contact with the toilet seat to either raise or lower the seat. As is well understood, the toilet seat and toilet seat area require a high level of disinfecting maintenance in order to provide a relatively free area from bacteria and germs. Since continued disinfection of this area is generally not feasible, a toilet seat will typically not be maintained in its most sanitary condition. Consequently, any user who must physically contact the toilet seat to either raise or lower it will be subject to these germs, and thus, may put his or her health at differing levels of unnecessary risk.

U.S. Pat. No. 5,307,524 to Veal discloses an automatic toilet seat device which will cause a toilet seat to be either raised or lowered at the push of a single button and further, will automatically lower the toilet seat after the flush action of the toilet. A first switch associated with the device will, when activated, cause the toilet seat to be raised by an electric motor. Once the toilet user has flushed the toilet, a float switch associated with a tank of the toilet will cause the motor to lower the toilet seat. The control circuit controlling the automatic toilet seat device is microprocessor controlled and includes an over-current detection circuit. The over-current detection circuit will detect over-current in the motor when the seat is completely raised or lowered such that the microprocessor will stop the motor from turning. Unfortunately, this prior art example is not designed for lifting and lowering both the toilet seat and the toilet seat lid.

U.S. Pat. No. 5,153,946 to Yoke discloses a toilet having a toilet bowl and a lid mounted to pivot between a closed position covering the bowl and an open position pivoted approximately 90 degree from the bowl. An apparatus is included for automatically closing the lid, which includes a control mechanism engageable with the lid for locking the lid in the open position when the lid is pivoted to the open position and a timer mechanism for actuating the control mechanism to release the lid from the open position after the passage of a predetermined time. Where the toilet includes a toilet seat pivotally mounted to the toilet bowl between the bowl and the lid and is pivotal from a closed position resting atop the bowl, a timer suspension system temporarily suspends operation of the timer mechanism while at least a predetermined weight is applied to the seat in the closed position. Unfortunately, this prior art example does not include a method for manually biasing a toilet seat and lid to a closed position.

Accordingly, the present invention is disclosed in order to overcome the above noted shortcomings. The combined toilet and automated toilet seat lifting device is convenient and easy to use, lightweight yet durable in design, and designed for the simplification of bathroom procedures. The device is simple to use, inexpensive, and designed for many years of repeated use.

BRIEF SUMMARY OF THE INVENTION

In view of the foregoing background, it is therefore an object of the present invention to provide an apparatus for automatically lifting a toilet seat. These and other objects, features, and advantages of the invention are provided by a combined toilet and automated toilet seat lifting device. It is noted that the term toilet seat and toilet lid are used interchangeably throughout the application. Therefore, the toilet seat may be defined as either an isolated toilet seat or a combined toilet seat and toilet rim throughout the present application. Likewise, the toilet rim may be defined as either an isolated toilet rim or a combined toilet seat and toilet rim throughout the present application.

A combined toilet and automated toilet seat lifting device may include a toilet that effectively has a toilet seat pivotally attached thereto, and a mechanism for automatically articulating the toilet seat from a remote distance such that a user maintains their hands spaced from the toilet seat while the toilet seat travels along an arcuate path defined between fully raised and lowered positions respectively. Such an automatic articulating mechanism is preferably and selectively adapted between alternate operating modes, and each of the operating modes may cause the toilet seat to articulate at a unique and constant velocity along the arcuate path respectively.

Such a unique and constant velocity may be selected from a group of unique and constant velocities which may include a first constant velocity, a second constant velocity and a third constant velocity respectively. Such first, second and third constant velocities are preferably calibrated in such a manner that a total travel time of the toilet seat between the open and closed positions is conveniently a minimum value at the first constant velocity and a maximum value at the third constant velocity respectively. The toilet seat may have zero acceleration while traveling along the arcuate path and thereby may maintain a smooth and continuous displacement for prohibiting undesirable jerking of the toilet seat during articulation procedures.

The automatic articulating mechanism may include a user interface spaced from the toilet. Such a user interface preferably generates and transmits first and second control signals based upon receipt of first and second user inputs. The mechanism may further include a controller communicatively coupled to the user interface and the toilet seat respectively. Such a controller is preferably responsive to the first control signal when the toilet seat is stationary such that the travel speed is advantageously configured to operate at a desired one of the alternating velocities. The controller further may be responsive to the second control signal and thereby may regulate displacement of the toilet seat between the open and closed positions. The controller preferably includes a transceiver in communication with the user interface for receiving and verifying an authenticity of the first and second control signals, a motor electrically coupled to the transceiver and responsive to the first and second control signals respectively, and a gear assembly operatively engaged with the motor and the toilet seat respectively such that the toilet seat is articulated at a desired one of the operating modes along the arcuate path.

Such a gear assembly may include a rotating first wheel which effectively faces a first direction and may include a plurality of pegs extending outwardly from a front face thereof. Such pegs are preferably arranged in first, second and third annular rows concentrically offset from a center of the first wheel and each of such first, second and third annular rows may be mutually exclusive and maintain fixed first, second and third radial distances from the center of the first wheel respectively. The gear assembly may further include a rotating second wheel facing a second direction that is orthogonal to the first direction. Such a second wheel preferably has an outer perimeter provided with a plurality of spaced notches directly and removably interfitted with the first wheel pegs in such a manner that the first and second wheels rotate along mutually exclusive arcuate paths that are aligned perpendicular to each other.

The gear assembly may further include a drive shaft that has a first end coupled to the motor and further may have a second end coupled to the first wheel. Such a drive shaft may be axially reciprocated along a linear path in response to the first control signal such that the first wheel is selectively engaged and disengaged from the second wheel while the toilet seat is stationary and thereby may permit the user to adjustably position the second wheel at a desired one of the first, second and third annular rows. The gear assembly may further include a rectilinear first shaft registered orthogonal to the front face of the first wheel such that the first shaft is coaxially aligned with a center of the first wheel. Such a first shaft is preferably penetrated through a center of the first wheel wherein the first wheel may be rotatably journaled about the first shaft, and the first shaft may further have a plurality of detents conveniently extending outwardly therefrom and spaced along a partial length of the first shaft.

The gear assembly may further include a plurality of brackets directly abutted against front and rear faces of the second wheel respectively. Each of such brackets may have a notch advantageously formed therein. Such notches preferably extend radially outwardly from an inner edge of the brackets respectively such that the detents are removably engaged with the notches as the brackets and the second wheel may be slidably displaced along a longitudinal length of the first shaft.

A rectilinear second shaft may have a first end directly anchored to the front face of the second wheel. Such a second shaft may further have a second end statically connected to the first shaft and may define a stop against which a leading one of the brackets is prohibited from passing therebeyond. The second wheel is preferably rotatably journaled about the second shaft, and a coupling may have a first portion statically mated to the first wheel. Such a coupling may further have a second portion registered orthogonal to the first portion and parallel to the second shaft respectively. Such a second portion of the coupling is preferably statically mated with a bottom end of the toilet seat such that the toilet seat may be pivoted in sync with the second wheel as the first wheel is journaled about the second shaft by a rotational motion of the drive shaft.

The second wheel notches are preferably detachably engaged with corresponding ones of the pegs associated with one of the first, second and third annular rows such that the second wheel may be effectively caused to selectively rotate at one of the first, second and third constant velocities respectively. The first constant velocity is preferably achieved by aligning the second wheel notches with the corresponding pegs of the first annular row when the first annular row is seated proximal to the center of the first wheel. The third constant velocity may be achieved by aligning the second wheel notches with the corresponding pegs of the third annular row when the third annular row is seated distal to the center of the first wheel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 2:
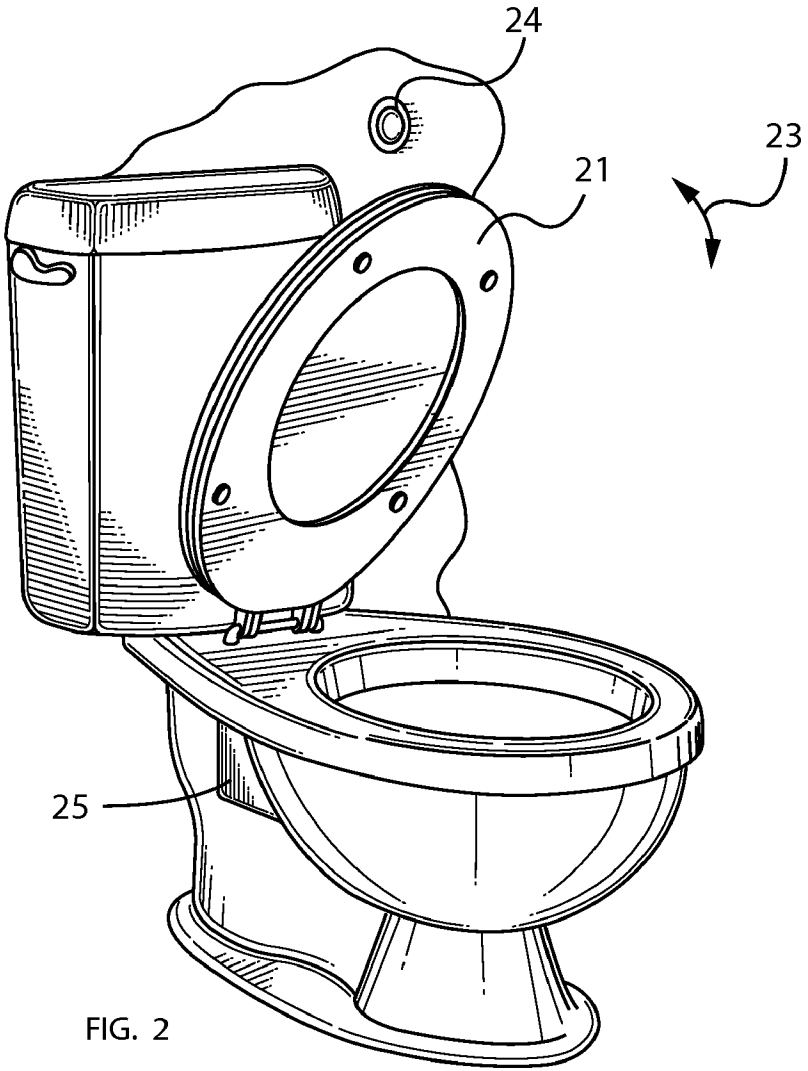
FIG. 2 is a perspective view of the combined toilet and automated toilet seat lifting device, with the toilet seat and lid articulated in an open position, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-6 by the reference numeral 10 and is intended to provide a combined toilet and automated toilet seat lifting device. It should be understood that the device 10 may be used to lift the lids of many different types of apparatuses and should not be limited to use with only those types of toilets mentioned herein. It is noted that the term toilet seat 21 and toilet lid are used interchangeably throughout the application. Therefore, the toilet seat 21 may be defined as either an isolated toilet seat 21 or a combined toilet seat 21 and toilet rim throughout the present application. Likewise, the toilet rim may be defined as either an isolated toilet rim or a combined toilet seat 21 and toilet rim throughout the present application.

Figure 1:
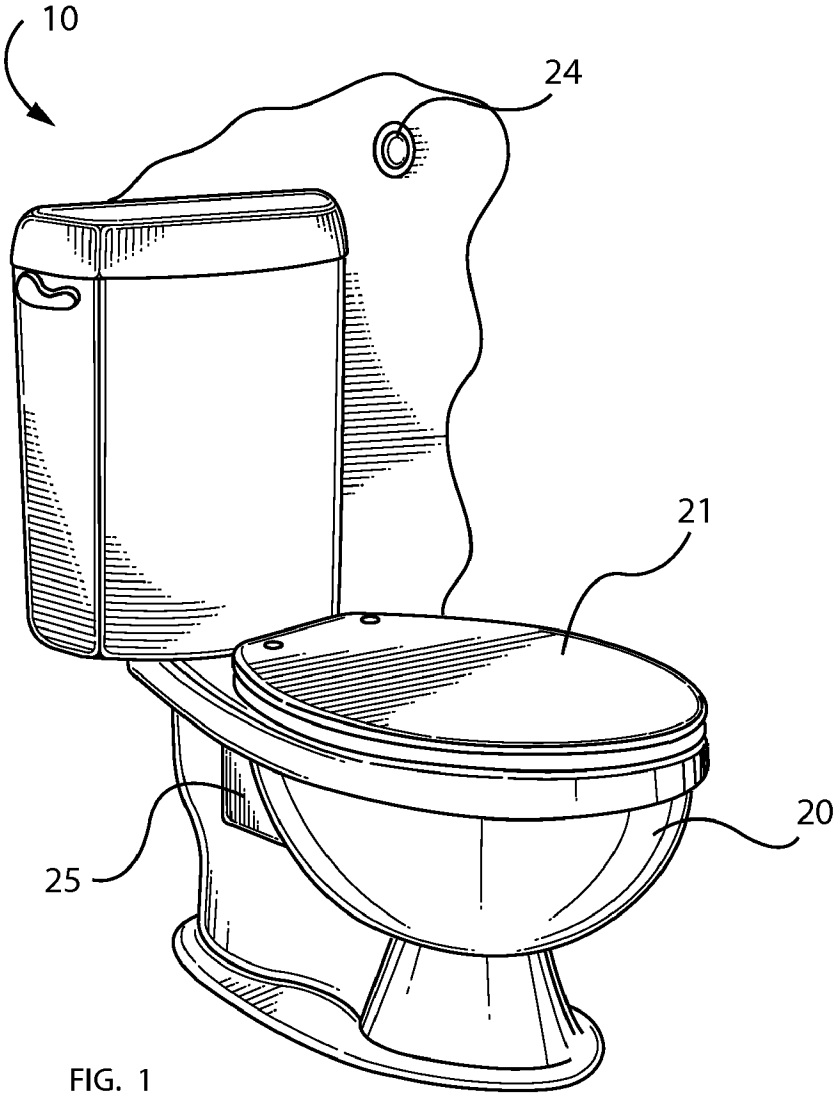
FIG. 1 is a perspective view of the combined toilet and automated toilet seat lifting device, with the toilet seat and lid articulated in a closed position, in accordance with the present invention.
Figure 3A:
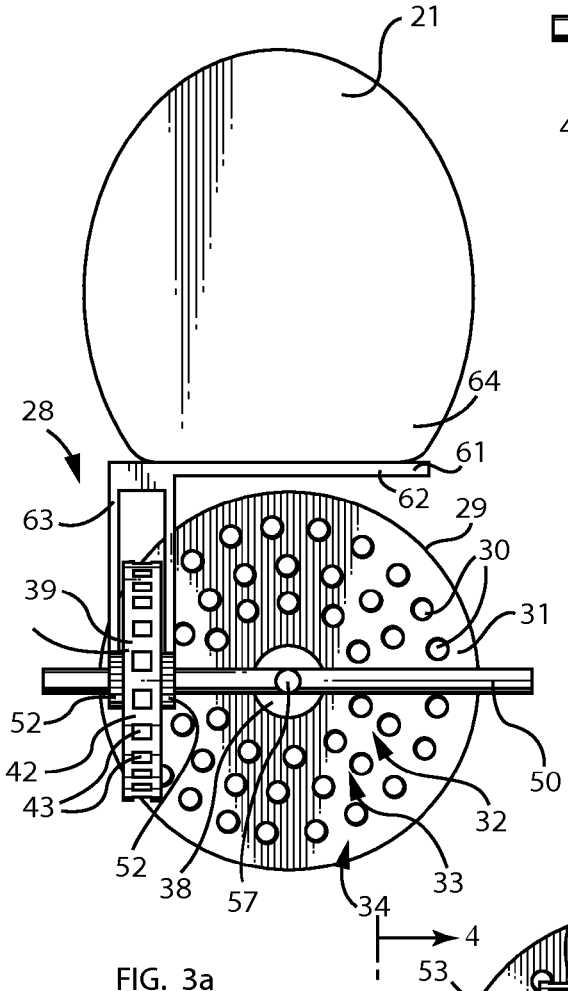
FIG. 3*a* is a front elevational view of the gear assembly and toilet lid, wherein the gear assembly is adapted to a first operating mode defined along an outermost concentric row of pegs.
Figure 3B:
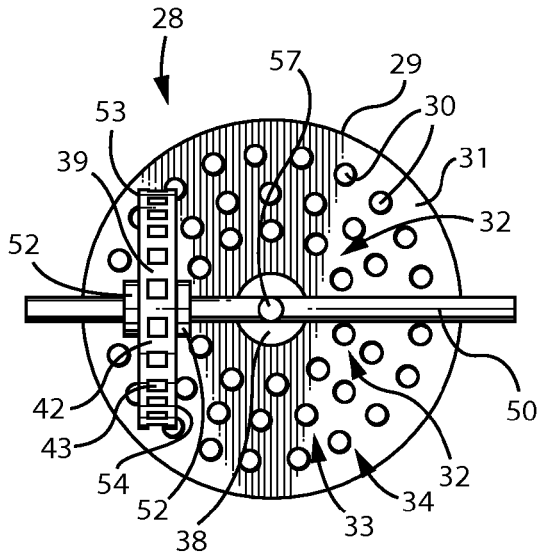
FIG. 3*b* is a front elevational view of the gear assembly, wherein the gear assembly is adapted to a second operating mode defined along a middle concentric row of pegs.
Figure 3C:
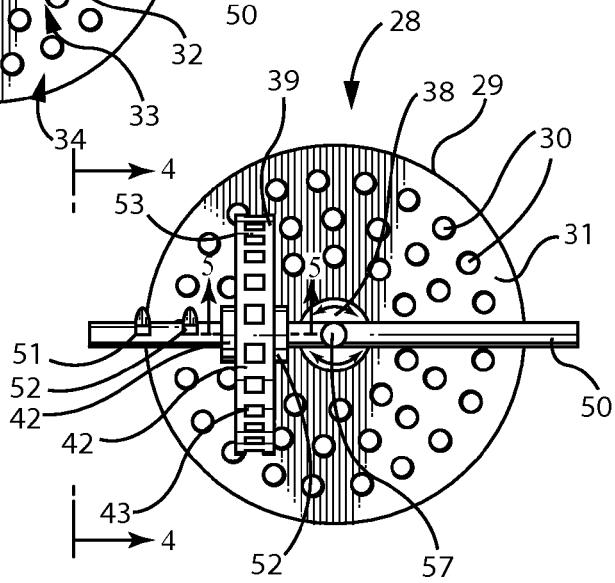
FIG. 3*c* is another front elevational view of the gear assembly, wherein the gear assembly is adapted to a third operating mode defined along an innermost concentric row of pegs.
Figure 4A:
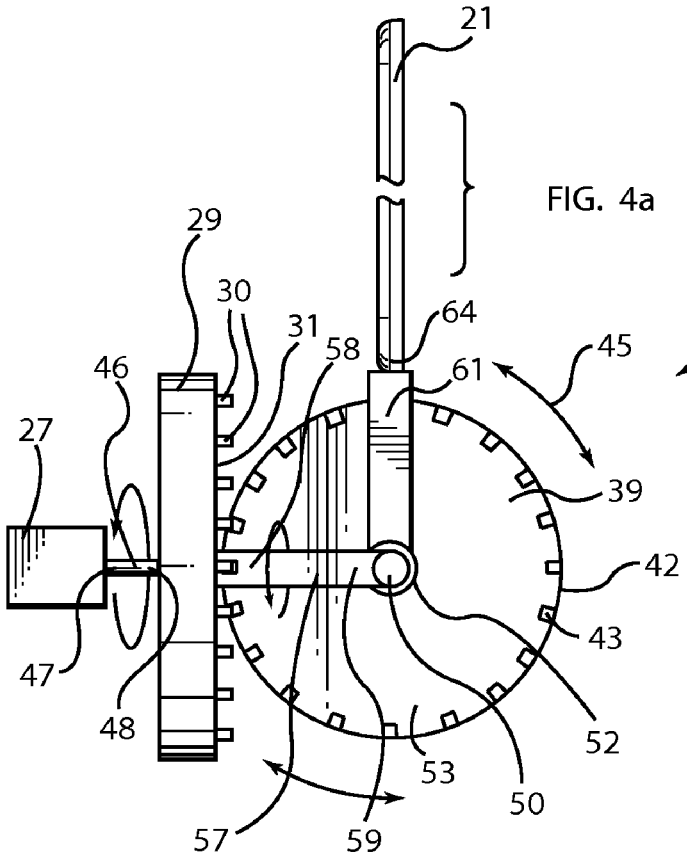
FIG. 4*a* is a cross sectional view of the gear assembly with the toilet lid articulated in a closed position, taken along line 4-4, as seen in FIG. 3*c;*
Figure 5:
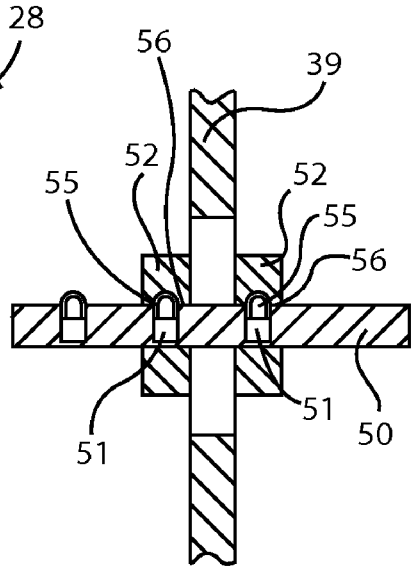
FIG. 5 is a cross sectional view of the brackets and detents, taken along line 5-5, as seen in FIG. 3*c*.
Figure 4B:
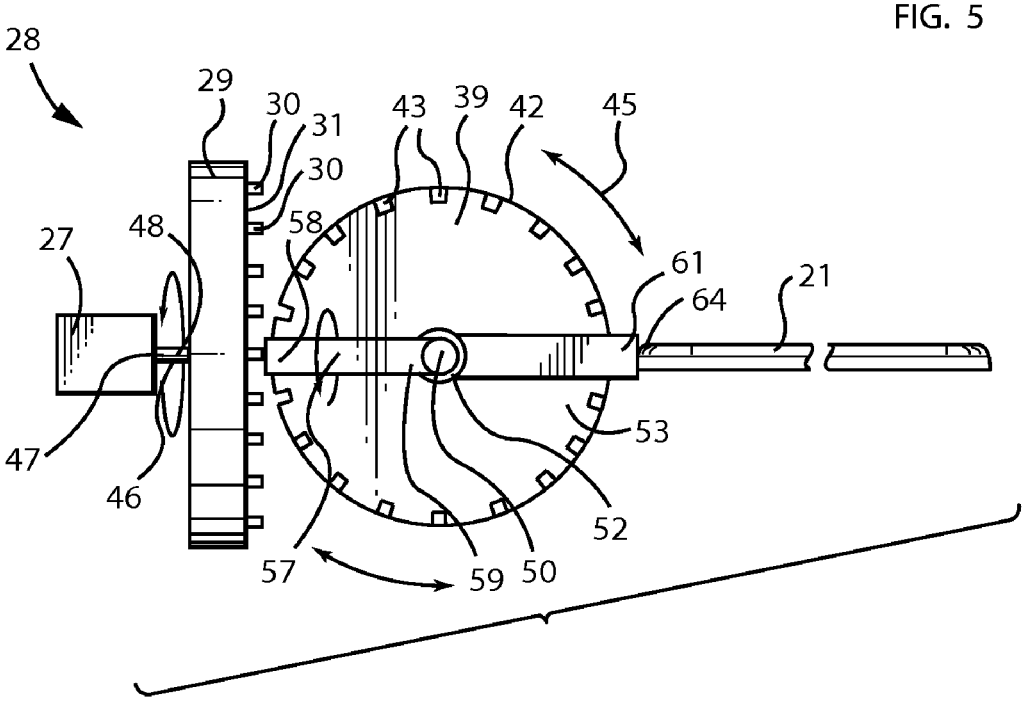
FIG. 4*b* is a cross sectional view of the gear assembly with the toilet lid articulated in an open position, taken along line 4-4, as seen in FIG. 3*c;*
Figure 6:
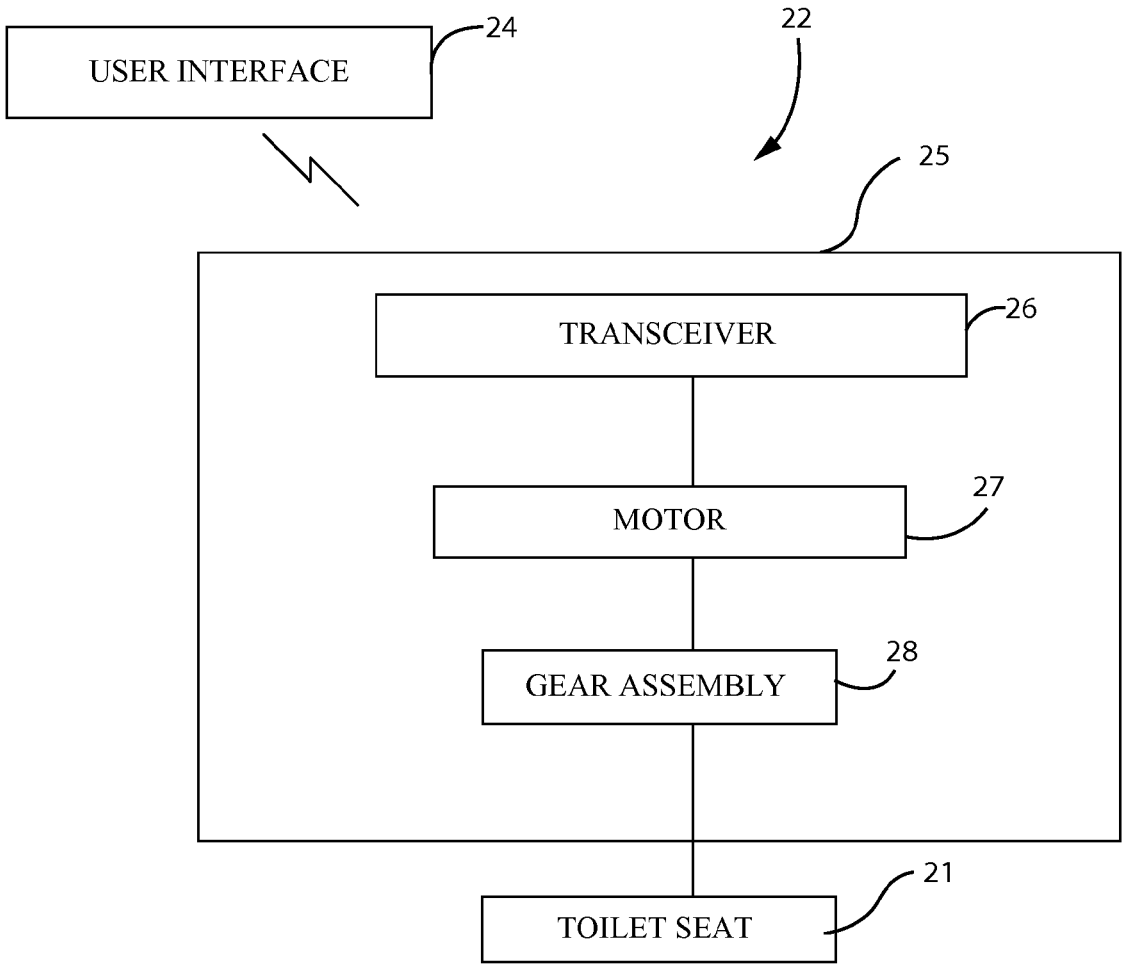
FIG. 6 is a schematic block diagram of the automatic articulating mechanism, in accordance with the present invention.

Referring initially to FIGS. 1, 2 and 6 a combined toilet and automated toilet seat lifting device 10 may include a toilet 20 that has a toilet seat 21 pivotally attached thereto, and a mechanism 22 for automatically articulating the toilet seat from a remote distance which is essential such that a user maintains their hands spaced from the toilet seat 21 while the toilet seat 21 travels along an arcuate path 23 defined between fully raised and lowered positions respectively. Such an automatic articulating mechanism 22 is preferably and selectively adapted between alternate operating modes, and each of the operating modes may cause the toilet seat 21 to articulate at a unique and constant velocity along the arcuate path respectively. The combination of the toilet 20, toilet seat 21 and automatic articulating mechanism 22 provides the unpredictable and unexpected result of ensuring that a user is never in direct contact with germs or bacteria that may be found on a toilet seat and/or lid.

Such a unique and constant velocity may be selected from a group of unique and constant velocities which may include a first constant velocity, a second constant velocity and a third constant velocity respectively. Such first, second and third constant velocities are preferably calibrated in such a manner that a total travel time of the toilet seat 21 between the open and closed positions is a minimum value at the first constant velocity and a maximum value at the third constant velocity respectively. The toilet seat 21 may have zero acceleration while traveling along the arcuate path and thereby may maintain a smooth and continuous displacement for prohibiting undesirable jerking of the toilet seat 21 during articulation procedures.

Referring to FIGS. 1 through 6, the automatic articulating mechanism 22 may include a user interface 24 spaced from the toilet 20. Such a user interface 24 preferably generates and transmits first and second control signals based upon receipt of first and second user inputs. The mechanism 22 may further include a controller 25 communicatively coupled to the user interface 24 and the toilet seat 21 respectively. Such a controller 25 is preferably responsive to the first control signal when the toilet seat 21 is stationary which is important such that the travel speed is configured to operate at a desired one of the alternating velocities.

The controller 25 further may be responsive to the second control signal and thereby may regulate displacement of the toilet seat 21 between the open and closed positions. The controller 25 preferably includes a transceiver 26 in communication with the user interface 24 for receiving and verifying an authenticity of the first and second control signals, a motor 27 electrically coupled to the transceiver 26 and responsive to the first and second control signals respectively, and a gear assembly 28 operatively engaged with the motor 27 and the toilet seat 21 respectively which is vital such that the toilet seat 21 is articulated at a desired one of the operating modes along the arcuate path 23. The user interface 24 provides an unpredictable and unexpected result which is not rendered obvious by one skilled in the art because a user may manually operate the toilet seat by activating the user interface 24. In addition, the user interface 24 provides a visual stimulation, thereby reminding boys and men to articulate the toilet seat 21 and/or lid into its appropriate position.

Such a gear assembly 28 may include a rotating first wheel 29 which faces a first direction and may include a plurality of pegs 30 extending outwardly from a front face 31 thereof. Such pegs 30 are preferably arranged in first, second and third annular rows 32, 33, 34 concentrically offset from a center of the first wheel 29 and each of such first, second and third annular rows 32, 33, 34 may be mutually exclusive and maintain fixed first, second and third radial distances from the center 38 of the first wheel 29 respectively. The gear assembly 28 may further include a rotating second wheel 39 facing a second direction that is orthogonal to the first direction. Such a second wheel 39 preferably has an outer perimeter 42 provided with a plurality of spaced notches 43 directly and removably interfitted, without the use of intervening elements, with the first wheel pegs 30 in such a manner that the first and second wheels 29, 39 rotate along mutually exclusive arcuate paths 45 that are aligned perpendicular to each other.

Referring to FIGS. 3*a* through 5, the gear assembly 28 may further include a drive shaft 46 that has a first end coupled 47 to the motor 27 and further may have a second end 48 coupled to the first wheel 29. Such a drive shaft 46 may be axially reciprocated along a linear path in response to the first control signal which is crucial such that the first wheel 29 is selectively engaged and disengaged from the second wheel 39 while the toilet seat 21 is stationary and thereby may permit the user to adjustably position the second wheel 39 at a desired one of the first, second and third annular rows 32, 33, 34. The gear assembly 28 may further include a rectilinear first shaft 50 registered orthogonal to the front face 31 of the first wheel 29 which is essential such that the first shaft 50 is coaxially aligned with a center of the first wheel 29. Such a first shaft 50 is preferably penetrated through a center of the first wheel 29 wherein the first wheel 29 may be rotatably journaled about the first shaft 50, and the first shaft 50 may further have a plurality of detents 51 extending outwardly therefrom and spaced along a partial length of the first shaft 50.

The gear assembly 28 may further include a plurality of brackets 52 directly abutted, without the use of intervening elements, against front and rear faces 53, 54 of the second wheel 39 respectively. Each of such brackets 52 may have a notch 55 formed therein. Such notches 55 preferably extend radially outwardly from an inner edge 56 of the brackets 52 respectively which is crucial such that the detents 51 are removably engaged with the notches 55 as the brackets 52 and the second wheel 39 may be slidably displaced along a longitudinal length of the first shaft 50.

A rectilinear second shaft 57 may have a first end 58 directly anchored, without the use of intervening elements, to the front face 53 of the second wheel 39. Such a second shaft 57 may further have a second end 59 statically connected to the first shaft 50 and may define a stop against which a leading one of the brackets 52 is prohibited from passing therebeyond. The second wheel 39 is preferably rotatably journaled about the second shaft 57, and a coupling 61 may have a first portion 62 statically mated to the first wheel 29. Such a coupling 61 may further have a second portion 63 registered orthogonal to the first portion 62 and parallel to the second shaft 57 respectively. Such a second portion 63 of the coupling 61 is preferably statically mated with a bottom end 64 of the toilet seat 21 which is important such that the toilet seat 21 may be pivoted in sync with the second wheel 39 as the first wheel 29 is journaled about the second shaft 57 by a rotational motion of the drive shaft 46.

The second wheel notches 43 are preferably detachably engaged with corresponding ones of the pegs 30 associated with one of the first, second and third annular rows 32, 33, 34 which is vital such that the second wheel 39 may be caused to selectively rotate at one of the first, second and third constant velocities respectively. The first constant velocity is preferably achieved by aligning the second wheel notches 55 with the corresponding pegs 30 of the first annular row 32 when the first annular row 32 is seated proximal to the center 31 of the first wheel 29. The third constant velocity may be achieved by aligning the second wheel notches 55 with the corresponding pegs 30 of the third annular row 34 when the third annular row 34 is seated distal to the center 31 of the first wheel 29.

The device 10 may include an automatic articulating mechanism 22 which is directly connected, without the use of intervening elements, to a toilet seat 21 and/or lid for lifting the seat 21, as well as the lid from the toilet bowl. Such a mechanism 22 is used for lifting and lowering a toilet seat 21 and lid, in accordance with the present invention. The device 10 preferably includes a standard toilet seat 20 and toilet seat 21 lid, both generally oval-shaped. Such a toilet seat 21 and lid are may be produced of heavy duty materials, like plastic and wood, for example. Of course, the seat 21 and lid could be produced in a variety of colors to correspond with existing bathroom décor, as is obvious to a person of ordinary skill in the art.

In an alternate embodiment, the seat 21 and lid may be pivotally connected to a toilet bowl 20 by way of threaded plastic bolts or screws, which run through the rear of the bowl. A small motor 27 may further be directly attached to the rear of the seat 21 and lid, without the use of intervening elements, respectively. The motor 27 may have roll bars that have a grooved rubber or plastic surface, for example, which is crucial for effectively serving as "teeth" to lift the lid or seat 21 upwards.

The device 10 may further include a controller 25 for serving as a transmitter for the device 10. Such a controller 25 may be rectangular or circular in shape and is preferably mounted to a support surface, like a bathroom wall. A user interface 24 may be located on a front portion of the controller 25 for use in conveniently raising the lid and seat 21 independent of one another. The controller 25 may include a transceiver 26, a motor 27, and a gear assembly 28. Alternately, the device 10 could feature, as one option, a standard power cord, to be connected to a standard power outlet and operating on conventional 110 volts, 60 hertz power, as is obvious to a person of ordinary skill in the art.

The present invention, as claimed, provides the unexpected and unpredictable benefit of a device 10 that is convenient and easy to use, is durable in design, is versatile in its applications, and provides users with a simple, yet clever means of lifting and lowering the toilet seat, as well as the toilet seat lid. Male users appreciate that by simply depressing the conveniently placed operational buttons located on the wall mounted controller 25, they can easily lift the seat up off the toilet, replacing it in a similar fashion after use. Additionally, the practical placement of the controller 25 provides a visual reminder to those men and boys who typically do not lift the toilet seat, to do so.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined toilet and automated toilet seat lifting device comprising:

a toilet having a toilet seat attached thereto; and means for automatically articulating said toilet seat between fully raised and lowered positions respectively, said automatic articulating means being selectively adapted between alternate operating modes, each of said operating modes causing said toilet seat to articulate at a unique and constant velocity along said arcuate path respectively;

wherein said unique and constant velocity is selected from a group of unique and constant velocities comprising: a first constant velocity, a second constant velocity and a third constant velocity respectively;

wherein said first, second and third constant velocities are calibrated in such a manner that a total travel time of said toilet seat between said open and closed positions is a minimum value at said first constant velocity and a maximum value at said third constant velocity respectively;

wherein said toilet seat has zero acceleration while traveling along said arcuate path and thereby maintains a smooth and continuous displacement for prohibiting undesirable jerking of said toilet seat during articulation procedures;

wherein said automatic articulating means comprises a user interface spaced from said toilet, said user interface generating and transmitting first and second control signals based upon receipt of first and second user inputs; and a controller communicatively coupled to said user interface and said toilet seat respectively, said controller being responsive to said first control signal when said toilet seat is stationary such that said travel speed is configured to operate at a desired one of said alternating velocities, said controller further being responsive to said second control signal and thereby regulating displacement of said toilet seat between said open and closed positions;

wherein said controller comprises a transceiver in communication with said user interface for receiving and verifying an authenticity of said first and second control signals;

a motor electrically coupled to said transceiver and being responsive to said first and second control signals respectively; and a gear assembly operatively engaged with said motor and said toilet seat respectively such that said toilet seat is articulated at a desired one of said operating modes along said arcuate path;

wherein said gear assembly comprises a rotating first wheel facing a first direction and including a plurality of pegs extending outwardly from a front face thereof, said pegs being arranged in first, second and third annular rows concentrically offset from a center of said first wheel, each of said first, second and third annular rows being mutually exclusive and maintaining fixed first, second and third radial distances from said center of said first wheel respectively;

a rotating second wheel facing a second direction that is orthogonal to said first direction, said second wheel having an outer perimeter provided with a plurality of spaced notches directly and removably interfitted with said first wheel pegs in such a manner that said first and second wheels rotate along mutually exclusive arcuate paths that are aligned perpendicular to each other; and a drive shaft having a first end coupled to said motor and further having a second end coupled to said first wheel, said drive shaft being axially reciprocated along a linear path in response to said first control signal such that said first wheel is selectively engaged and disengaged from said second wheel while said toilet seat is stationary and thereby permit the user to adjustably position said second wheel at a desired one of said first, second and third annular rows.

2. The combined toilet and automated toilet seat lifting device of claim 1, wherein said gear assembly further comprises:

a rectilinear first shaft registered orthogonal to said front face of said first wheel such that said first shaft is coaxially aligned with a center of said first wheel, said first shaft being penetrated through a center of said first wheel wherein said first wheel is rotatably journaled about said first shaft, said first shaft having a plurality of detents extending outwardly therefrom and spaced along a partial length of said first shaft;

a plurality of brackets directly abutted against front and rear faces of said second wheel respectively, each of said brackets having a notch formed therein, said notches extending radially outwardly from an inner edge of said brackets respectively such that said detents are removably engaged with said notches as said brackets and said second wheel are slidably displaced along a longitudinal length of said first shaft;

a rectilinear second shaft having a first end directly anchored to said front face of said second wheel, said second shaft further having a second end statically connected to said first shaft and defining a stop against which a leading one of said brackets is prohibiting from passing therebeyond, said second wheel being rotatably journaled about said second shaft; and a coupling having a first portion statically mated to said first wheel, said coupling further having a second portion registered orthogonal to said first portion and parallel to said second shaft respectively, said second portion of said coupling being statically mated with a bottom end of said toilet seat such that said toilet seat is pivoted in sync with said second wheel as said first wheel is journaled about said second shaft by a rotational motion of said drive shaft.

3. The combined toilet and automated toilet seat lifting device of claim 2, wherein said second wheel notches are detachably engaged with corresponding ones of said pegs associated with one of said first, second and third annular rows such that said second wheel is caused to selectively rotate at one of said first, second and third constant velocities respectively;

wherein said first constant velocity is achieved by aligning said second wheel notches with said corresponding pegs of said first annular row, said first annular row being seated proximal to said center of said first wheel;

wherein said third constant velocity is achieved by aligning said second wheel notches with said corresponding pegs of said third annular row, said third annular row being seated distal to said center of said first wheel.

4. A combined toilet and automated toilet seat lifting device comprising:

a toilet having a toilet seat pivotally attached thereto; and means for automatically articulating said toilet seat from a remote distance such that a user maintains their hands spaced from said toilet seat while said toilet seat travels along an arcuate path defined between fully raised and lowered positions respectively, said automatic articulating means being selectively adapted between alternate operating modes, each of said operating modes causing said toilet seat to articulate at a unique and constant velocity along said arcuate path respectively;

wherein said unique and constant velocity is selected from a group of unique and constant velocities comprising: a first constant velocity, a second constant velocity and a third constant velocity respectively;

wherein said first, second and third constant velocities are calibrated in such a manner that a total travel time of said toilet seat between said open and closed positions is a minimum value at said first constant velocity and a maximum value at said third constant velocity respectively;

wherein said toilet seat has zero acceleration while traveling along said arcuate path and thereby maintains a smooth and continuous displacement for prohibiting undesirable jerking of said toilet seat during articulation procedures;

wherein said automatic articulating means comprises a user interface spaced from said toilet, said user interface generating and transmitting first and second control signals based upon receipt of first and second user inputs; and a controller communicatively coupled to said user interface and said toilet seat respectively, said controller being responsive to said first control signal when said toilet seat is stationary such that said travel speed is configured to operate at a desired one of said alternating velocities, said controller further being responsive to said second control signal and thereby regulating displacement of said toilet seat between said open and closed positions;

wherein said controller comprises a transceiver in communication with said user interface for receiving and verifying an authenticity of said first and second control signals;

a motor electrically coupled to said transceiver and being responsive to said first and second control signals respectively; and a gear assembly operatively engaged with said motor and said toilet seat respectively such that said toilet seat is articulated at a desired one of said operating modes along said arcuate path;

wherein said gear assembly comprises a rotating first wheel facing a first direction and including a plurality of pegs extending outwardly from a front face thereof, said pegs being arranged in first, second and third annular rows concentrically offset from a center of said first wheel, each of said first, second and third annular rows being mutually exclusive and maintaining fixed first, second and third radial distances from said center of said first wheel respectively;

a rotating second wheel facing a second direction that is orthogonal to said first direction, said second wheel having an outer perimeter provided with a plurality of spaced notches directly and removably interfitted with said first wheel pegs in such a manner that said first and second wheels rotate along mutually exclusive arcuate paths that are aligned perpendicular to each other; and a drive shaft having a first end coupled to said motor and further having a second end coupled to said first wheel, said drive shaft being axially reciprocated along a linear path in response to said first control signal such that said first wheel is selectively engaged and disengaged from said second wheel while said toilet seat is stationary and thereby permit the user to adjustably position said second wheel at a desired one of said first, second and third annular rows.

5. The combined toilet and automated toilet seat lifting device of claim 4, wherein said gear assembly further comprises:

a rectilinear first shaft registered orthogonal to said front face of said first wheel such that said first shaft is coaxially aligned with a center of said first wheel, said first shaft being penetrated through a center of said first wheel wherein said first wheel is rotatably journaled about said first shaft, said first shaft having a plurality of detents extending outwardly therefrom and spaced along a partial length of said first shaft;

a plurality of brackets directly abutted against front and rear faces of said second wheel respectively, each of said brackets having a notch formed therein, said notches extending radially outwardly from an inner edge of said brackets respectively such that said detents are removably engaged with said notches as said brackets and said second wheel are slidably displaced along a longitudinal length of said first shaft;

a rectilinear second shaft having a first end directly anchored to said front face of said second wheel, said second shaft further having a second end statically connected to said first shaft and defining a stop against which a leading one of said brackets is prohibiting from passing therebeyond, said second wheel being rotatably journaled about said second shaft; and a coupling having a first portion statically mated to said first wheel, said coupling further having a second portion registered orthogonal to said first portion and parallel to said second shaft respectively, said second portion of said coupling being statically mated with a bottom end of said toilet seat such that said toilet seat is pivoted in sync with said second wheel as said first wheel is journaled about said second shaft by a rotational motion of said drive shaft.

6. The combined toilet and automated toilet seat lifting device of claim 5, wherein said second wheel notches are detachably engaged with corresponding ones of said pegs associated with one of said first, second and third annular rows such that said second wheel is caused to selectively rotate at one of said first, second and third constant velocities respectively;

wherein said first constant velocity is achieved by aligning said second wheel notches with said corresponding pegs of said first annular row, said first annular row being seated proximal to said center of said first wheel;

wherein said third constant velocity is achieved by aligning said second wheel notches with said corresponding pegs of said third annular row, said third annular row being seated distal to said center of said first wheel.

* * * * *